US005289593A

United States Patent [19]

Lawrence

[11] Patent Number: 5,289,593

[45] Date of Patent: Mar. 1, 1994

[54] AUTOMATIC CLOSURE FOR TOILET SEAT

[76] Inventor: James C. Lawrence, 851 Harrison, Valparaiso, Ind. 46383

[21] Appl. No.: 9,900

[22] Filed: Mar. 18, 1993

[51] Int. Cl.[5] ..... A47K 13/10

[52] U.S. Cl. ..... 4/246.1

[58] Field of Search ..... 4/246.1, 246.2, 246.3, 4/246.4, 250, 408

[56] References Cited

U.S. PATENT DOCUMENTS

| | | | |
|---|---|---|---|
| 2,117,663 | 7/1937 | Hill . | |
| 3,781,924 | 1/1974 | Davis, Jr. . | |
| 4,433,442 | 4/1982 | Liou . | |
| 4,777,671 | 10/1988 | Kearns . | |
| 4,914,757 | 4/1990 | Johnson . | |
| 5,058,216 | 10/1991 | Trayer et al. . | |
| 5,177,818 | 1/1993 | Tsai | 4/250 X |
| 5,222,260 | 6/1993 | Piper | 4/246.1 |

FOREIGN PATENT DOCUMENTS

| | | |
|---|---|---|
| 72094 | 11/1893 | Fed. Rep. of Germany . |
| 24187 | 5/1900 | Fed. Rep. of Germany . |
| 203966 | 11/1908 | Fed. Rep. of Germany . |

*Primary Examiner*—Charles E. Phillips
*Attorney, Agent, or Firm*—Richard G. Kinney

[57] ABSTRACT

An improved toilet seat closure is described employing weight-driven cords or cables for pivoting forward and lowering a toilet seat and its lid without a loud noise upon flushing of the toilet. The seat and mechanism for achieving the automatic closing can be easily retrofitted to existing toilets without any unsightly or major modification of the toilet or tank. The mechanism employs a flexible cable or cord which runs through a tubular sleeve and extends under and behind the tank and over the rear lip of the tank so as to be substantially out of sight to the users. The cord or cable is connected to a weight in the tank (which weight has a specific gravity slightly higher than 1) so that on flushing the weight draws down the cord or cable a short distance. The cord also runs over a fixed pulley and runs free to the end of a pivoting arm extension from the seat member. The end points of arc of the end of the pivoting arm are so related to the fixed point that the falling weight causes the cable to initially pivot the arm and thus the seat member from its raised position forward to past its forward tipping or falling point. The seat thereby then pivots by gravity downward but is restrained and slowed by the cable and weight system as it approaches its down or closed position.

6 Claims, 4 Drawing Sheets

AUTOMATIC CLOSURE FOR TOILET SEAT

FIELD OF THE INVENTION

The present invention relates to automatic toilet seat closure devices and mechanisms.

BACKGROUND OF THE INVENTION

The proper "default" or between-use positioning of the common toilet seat is a matter that leads to domestic non-tranquility. Men commonly leave the seat up after use. Women generally prefer to find it down when they go to use the toilet. Whatever the psychological or cultural causes of this commonly-occurring difference of opinion, there has been long recognized a need for an automatic seat closure or lowerer so that men may leave the seat up and women find it down.

While some early privies provided for automatic closure of tight-fitting lids (E.g., German Patent 72,094, 1892, stepping off a floor board in front of privy lowers lid; German Patent 203,966, 1908; and U.S. Pat. No. 2,117,663, opening door to privy lowers lid), many modern suggestions exist for flush toilets which use the act of flushing to lower the lid. See, for example, U.S. Pat. Nos. 5,058,216; 4,914,757; 4,433,442; and 3,781,924. As far as applicant is aware, none of these suggestions have met with commercial success and, despite the great desirability for such a device, there is no automatic toilet seat closure in common commercial use in this country.

The reasons for this are believed to be the complex and unsightly nature of the prior suggestions, such as those of the U.S. patent references mentioned above. There, therefore, still exists a need for an automatic flush seat closure which is easy to make, install, use, and has an installed appearance which is not unsightly.

SUMMARY OF THE INVENTION

In overcoming one or more of the drawbacks of prior flush-actuated toilet seat closures, the present invention provides a self-lowering apparatus for lowering a pivotal toilet seat member, either the seat itself or its lid or both. The invention apparatus includes a rearward arm attached to the seat member. Attached to it is a flexible cable or cord which runs over a pulley or like fixed location behind and below the seat. The cable runs through a routing means (such as brackets and pulleys) to a weight in the toilet tank. When flushed, the falling water increases the force applied by the weight and pulls on the cable. The first location is so related to the arm's range of positions that, if the seat member is in its raised position, the pull on the cable from a flush pulls the arm and thus the member forward until it passes over the tipping point and starts to fall by gravity, but, before it can land down on the bowl, the cable catches it and checks its fall.

Another feature of the invention which allows for ease of installation is the use of a flexible tubular sleeve for the cable or cord.

The invention, together with further advantages and features thereof, may best be understood by reference to the following description taken in connection with the accompanying drawings, in the several figures of which like reference numerals identify like elements.

DETAILED DESCRIPTION OF ONE PREFERRED EMBODIMENT

Figure 1:
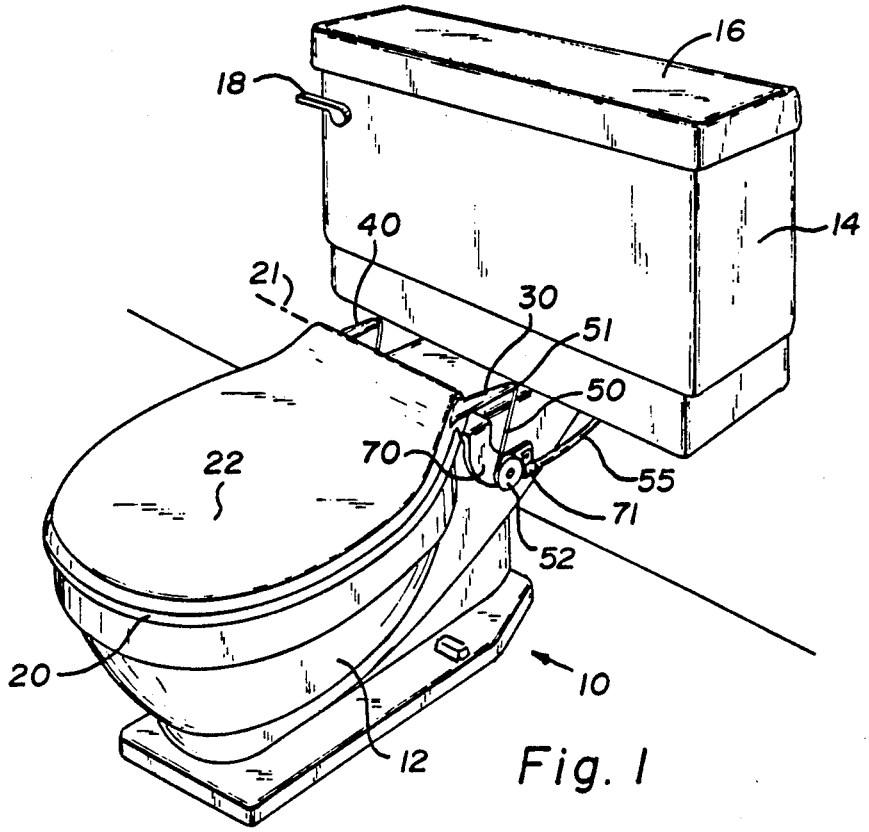
FIG. 1 is a perspective view of the left side of a flush toilet equipped with a toilet seat and a closure mechanism made in accordance with the principles of the present invention.

Referring to the figures and especially FIG. 1, there is depicted a conventional flush toilet 10 having a bowl 12 and a tank 14, a tank top 16, and a flush lever or handle 18. These may be entirely conventional and therefore need not be described in detail, it being understood that the manual depressing of the lever 18 opens a relatively large valve at the bottom of the tank 14 and empties or largely empties the water contained in the tank 14 into the bowl 12 to flush-clean it, and the majority of the water and any waste in the bowl 12 is passed through a trap to a sewage drain (not shown)—all in the conventional manner. After a flush, the tank 14 is refilled relatively slowly compared to the rapid drop of its water level upon flushing.

Figure 4:
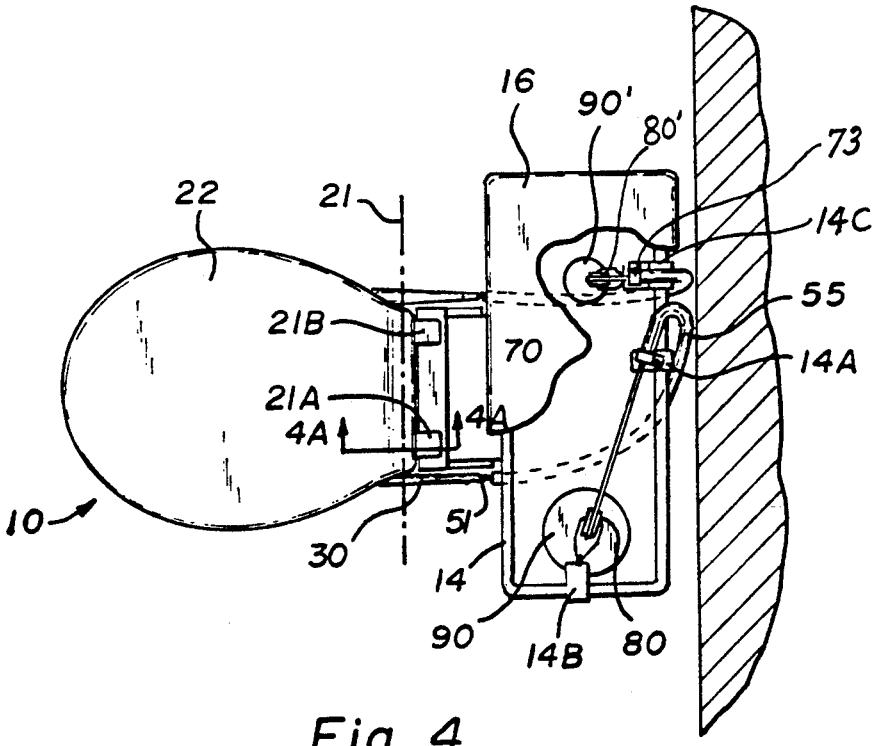
FIG. 4 is a top view of the toilet of FIGS. 1-3 with parts broken away to show interior parts and with some parts shown in dashed outline.
Figure 4A:
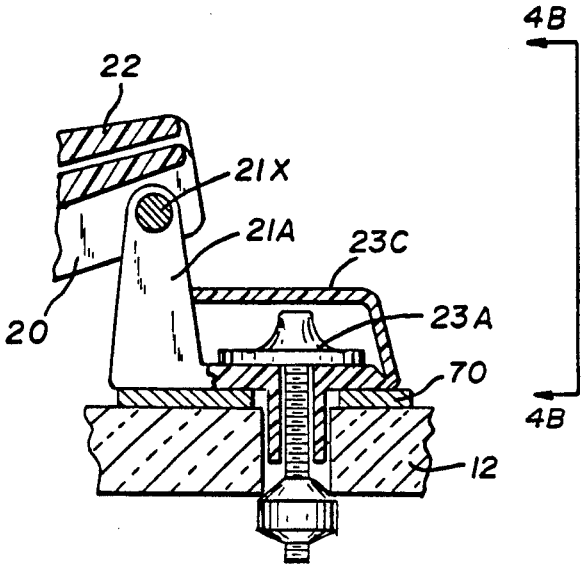
FIG. 4A is a partial sectional view as seen from the line 4A—4A in FIG. 4.
Figure 4B:
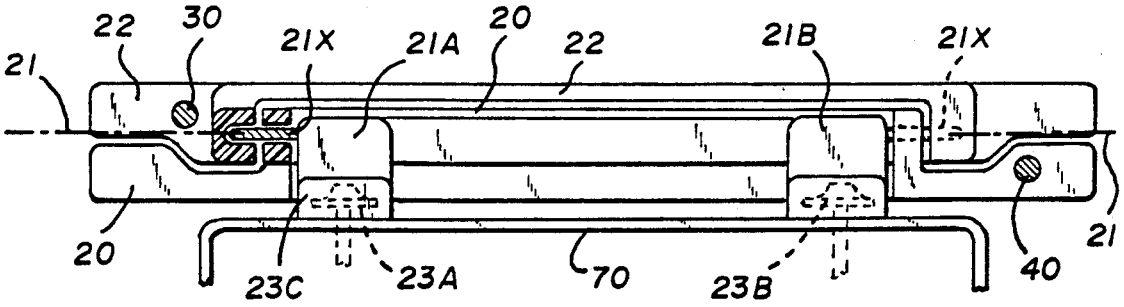
FIG. 4B is a partial view with parts broken away to show interior parts and other interior parts shown in dashed outline as seen from the line 4B—4B in FIG. 4A.

In accordance with the present invention, a modified toilet seat assembly 19 is provided including a seat member 20 and lid member 22. The seat assembly is affixed in the more-or-less conventional manner to the bowl 12 so that each member 20, 22 may be pivotally displaced about an axis 21 located toward the rear end of the members. That is, as shown in FIGS. 4, 4A and 4B, a pair of elbow members 21A and 21B are secured by plastic nut and bolt arrangement 23A and 23B (FIGS. 4A and 4B) through bores 12A and 12B defined in the bowl 12. (The tops of the bolts are covered by covers 23C.) These members 21A and 21B define pivot axles 21X which define the axis 21 of rotation for the seat 20 and lid 22. In accordance with the present invention, the nut and bolt arrangement 23A and 23B and the members 21A and 21B also secure in place a bracket 70.

Figure 2:
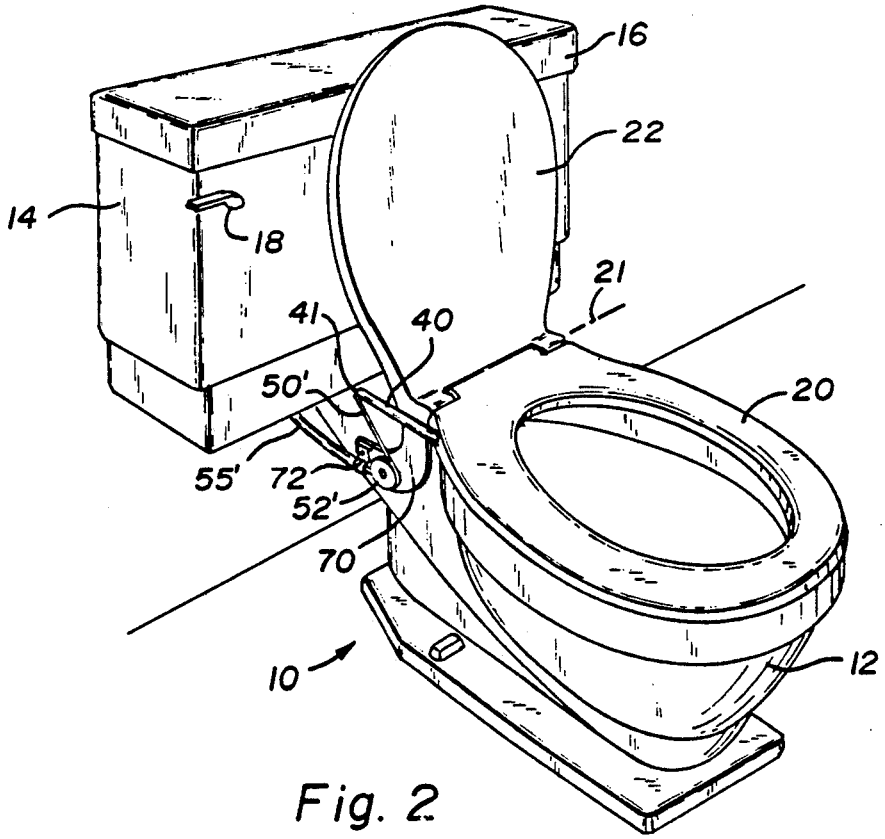
FIG. 2 is a perspective view of the right side of the toilet of FIG. 1.
Figure 5:
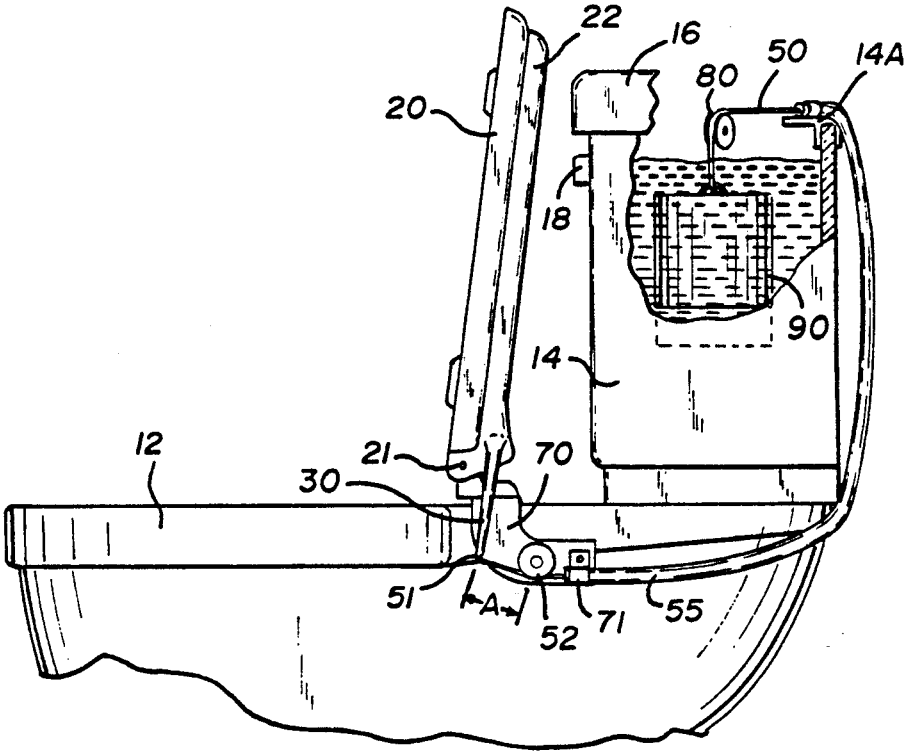
FIG. 5 is a side elevational view of the toilet of FIGS. 1-4 with the seat and lid in their raised position and with parts broken away to show interior parts.

The toilet seat 20 and lid 22 are, like conventional seats and lids, able to be raised and assume a stable position slightly beyond vertical, as shown in FIGS. 2 and 5. That is, they move slightly beyond 90 degrees from a closed horizontal position to a raised position. The weight of the seat and lid are so distributed as to cause the seat and lid to pivot downward when tipped forward to slightly less than vertical. That is, the center of mass of the seat member is well forward of the axis 21 as indicated by the point SCM in FIG. 6. If not restrained, the seat 20 and lid 22 would pivot down and bang against the bowl 12 and each other.

Figure 3:
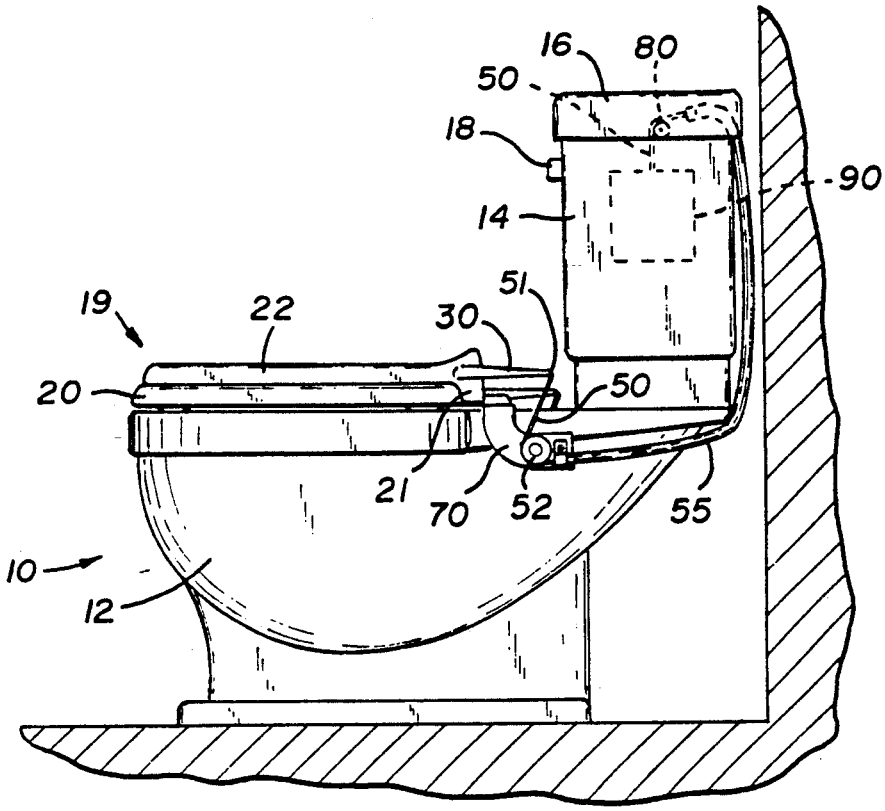
FIG. 3 is a side view of the toilet of FIGS. 1 and 2 with some interior hidden parts shown in dashed outline.
Figure 6:
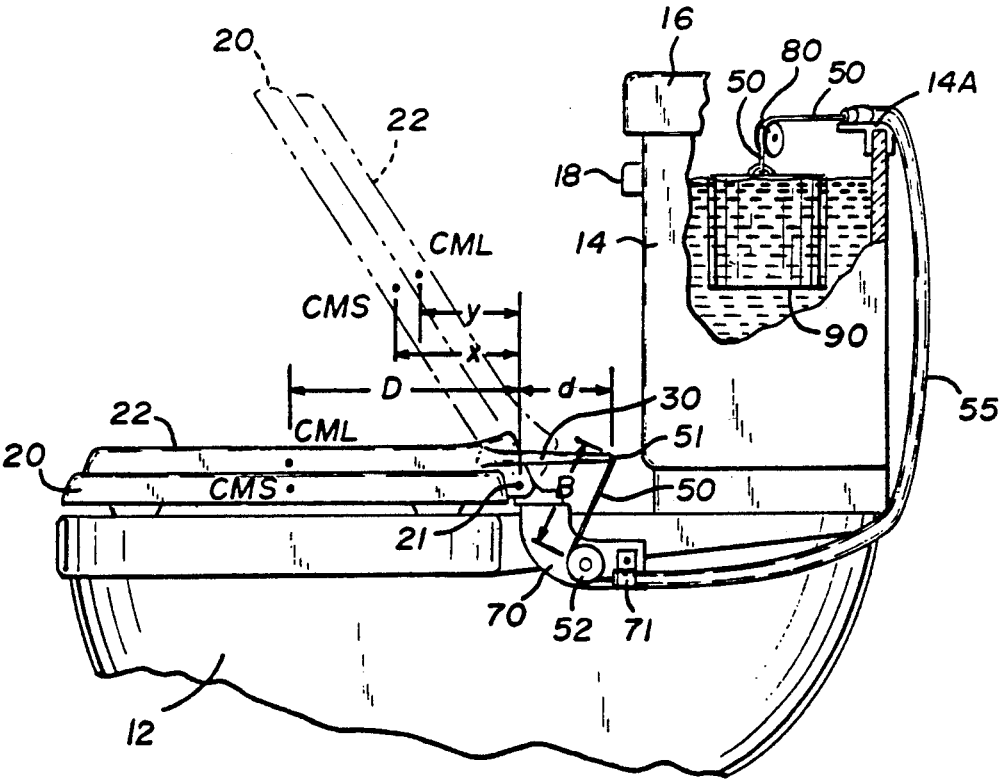
FIG. 6 is a view similar to that of FIG. 5 of the toilet of FIGS. 1-5 with parts in a moved position shown in dashed outline.

Also in accordance with the present invention, one or, as shown, both of the members 20 or 22 is provided with a rearward-extending arm such as the lid arm 30 (FIGS. 1, 3 and 4). At the end of the arm 30 is connected one end 51 of a flexible (but not elastic) cable or cord 50, which winds about a pulley 52 which is fixed in position by means of the bracket 70. The pulley 52 serves at a fixed location from which the cord or cable 50 extends to the arm connection, either in front of the pulley 52, as shown in FIG. 5, or above it, as shown in FIG. 6, or in the range of positions therebetween.

After running over the pulley 52, the cable 50 enters a plastic sleeve 55 and the combination of sleeve or tube 55 and interior cable 50 runs under and up the rear wall of the tank 14. The sleeve 55 is secured at one end to the bracket 70 by a clamp 71 and near its other end to a tank bracket 14A (FIG. 4) which helps guide the sleeve 55 over the rear edge of the tank and under the tank top 16. (Often, there is sufficient space under the loose-fitting top 16 for this to be done without modification of the tank during installation. Occasionally, in retrofitting the present system to an existing tank, a small and shallow notch needs to be made in the top lip or edge of the tank 14 to accommodate the cable 50 and sleeve 55.) The sleeve 55 ends at the bracket 14A but the cable 50 continues on to a second pulley 80 held in the tank by a second bracket 14B. Below the pulley 80, the cord or cable 50 is secured to a weight 90 which has a specific gravity slightly greater than 1 so that it moves up and down with the flushing of the toilet.

The length of the cable 50 between weight 90 and arm 30 is such that the cable is taut at either of the extreme positions of the arm 30 when the tank is filled. The geometry of the fixed position of the pivot 52 and the possible end positions of the arm 30 is shown in FIGS. 5 and 6. That is, the distance A in FIG. 5 is less than the distance B in FIG. 6.

As shown in FIG. 2, a similar, nearly mirror image, arrangement is provided, wherein arm 40 from the seat member 20 has an end 41 attached to a cable or cord 50' which runs freely to a pulley 52' mounted on another portion of the bracket 70. The cable 50' runs into and through a tube or sleeve 55' which also has one end secured by a clamp 72 to the bracket 70 and its other end secured by a clamp 73 (FIG. 4) which is mounted on a bracket 14C which, like the brackets 14A and 14B, are secured to the top of the walls of the tank 14. The clamps securing the tubes 55 and 55' are not so tight so as to prevent the free movement of the cord or cable 50, 50' in the tubes. (The use of such tubes of a preferably a waxy or slippery plastic, such as polypropylene, is a feature of the present invention which allows the cable connection between the bracket 70 and the tank 14 to be made easily and without any major modifications needed to the tank or attachments to the bottom of the tank or the surrounding walls.)

The bracket 14C cantilevers out over the top of the tank 14 and mounts a pulley 80'. The cable 50' extends from the tube 55' to pass over the pulley and is attached to a weight 90' positioned at least partly in the center of the tank 14.

The consequences of the geometry of the arm 30, 40 and the pulley 52, 52' will become clear from a discussion of the operation of the apparatus. Assume the starting conditions as shown in FIG. 5 with the lid 22 and seat 20 up in their raised position and the tank full. Now assume the user flushes the tank by pressing down lever 18. This causes the water in the tank 14 to fall fairly rapidly. The result is that the effective weight exerted by the weight 90 is increased. This pulls the cable or cord 50 downward and pulls the end of the arm 30 rearward, which moves the lid 22 forward to the left, as seen in FIG. 5. If the seat 20 is also up, the same result is achieved on its arm 40, and the seat 20 also moves forward. As the lid alone or lid and seat move past the vertical point, their weight tends to draw them downward and forward, and the lid (and seat, if raised) pivots forward, initially unrestrained by the cable. As the arm end swings further, however, and the point 51 advances above the plane defined by the fixed axis 21 and the pulley 52, the arm 30 starts to draw back on the cable 50. At the position shown in dashed outline in FIG. 6, the torque about axis 21 applied by the effective weight of the weights 90 and 90' counterbalances the torque of the center of mass CMS and CML of the lid and seat and stops the fall of the seat and lid. As the tank 14 refills, the effective weight of the weights 90 and 90' decreases, and torque applied about the axis 21 by the lever arms 30 and 40 decreases, and the lid pivots downward to its closed position shown in solid lines in FIG. 6. As the tank 14 is refilled substantially slowly, the fall of the lid 22 is likewise relatively slow, with the result that it does not "bang."

It should be noted that the torque at the axle 21 of the lowered seat and lid is the distance D in FIG. 6 times the weight of the lid and seat. The torque applied by weights 90, 90' upon flushing in this configuration equals the length of the arms 30 and 40 times the weight but reduced by the effect of the angle of the length of cable 50 between pulley 52 at the end of the arm 30. This torque applied by the weights 90, 90' is less than that of the seat, so that flushing of the toilet with the seat and lid down does not cause them to rise up.

Note that the torque applied about axis 21 by the weights 90, 90' (through the cables and arm) in a flushed toilet is more than that the raised seat applies, and that this torque goes from positive to negative as the seat members move from the position of FIG. 5 to that shown in dashed lines of FIG. 6. That is, the cables 50, 50' first pull the arms 30, 40, in a counterclockwise direction (FIG. 5) and then in a clockwise direction (FIG. 6). The torque applied by the cables 50, 50' is greater than the torque of the seat members in the arrangement shown in dashed lines in FIG. 6. That is, distances x and y times the weight of the seat member are less than the torque applied by the weights 90, 90' and this stops the seat members in the position approximately as shown. As the water rises in the tank, the torque applied by the cable and weight system decreases slowly and the seat members resume their full horizontal position.

The geometry of the moving parts of the arms 30, 40 and the pulley 52, 52' is such that the weights need only move a short (typically two or three inches) vertical distance during operation. This allows for ease of placement of the weights in the tank. Also, since the weights are (preferably slightly) greater than the density of the water, they can be made of a glass container and filled with water or water and sand.

The invention readily adapts itself to retrofitting. The bracket 70 may be made to telescope outward and inward somewhat, to accommodate the apparatus to bowls of differing widths; however, it may be easier to manufacture different-sized units specifically sized to particular toilets.

The assembly of the seat 20 and lid 22, together with the bracket 70 and cord 50, sleeve 55, weights 90, 90', and the associated brackets, can be sold together as a kit preferably sized and configured to fit a specific conventional toilet in common use. The kit would then be installed by the easy steps of first replacing the seat and lid assembly with assembly 21. Then running the attached sleeve 55 and 55' arrangement as shown and affixing the clips 14A, 14B and 14C as shown. These latter need only be pushed on to the top edge of the tank 14, filling with water and hanging the weights, and making sure the cord or cable 50, 50' is tight, and replacing the tank top 16 would complete the job.

A prototype of the invention has been built and tested and shown to work well. In this prototype, a nylon cord was used for the cable and polypropylene tubing for the sleeve 55 and a standard toilet seat and lid modified by adding a bracket and vertical arms. This unit was fitted to a conventional flush toilet and proved to work well.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

Among the changes that may well be made is to replace at least some of the pulleys by low-friction eyelets. Further, the arms may be made so as to be releasably removable, so that a user could attach and use only one, for example, and the seat could be used when the user does not wish to have the lid automatically operated.

I claim:

1. Self-lowering apparatus for lowering a toilet seat member in combination with a flush toilet, the toilet being of the type that has a water tank mounted adjacent and rearward thereof on a horizontal surface of a bowl, which tank when in operation holds water and the level of water in the tank falls upon flushing of the toilet, comprising:

a toilet seat member having means for securing it to the toilet bowl and having a rearward pivot for pivoting of said member slightly more than 90 degrees between a lowered position and a raised position, said seat member including an extension arm extending generally rearward beyond said pivot, said arm connected at one end to said seat member so as to pivot with it, such that, as the seat member pivots upward between said lowered and raised positions, the extension arm pivots downward slightly more than 90 degrees, said member having a tipping position of approximately 90 degrees with respect to said horizontal surface, which, if slightly forward thereof, said member tends to pivot downward by gravity;

a flexible cable connected at one end to said arm and at its other end to a weight at least partially submerged in the water in the tank, so that said weight will exert greater force on said cable when the water level falls in the tank than when the tank is full;

means mounting the cable so that the end of the cable connected to the arm runs free from a fixed location, which fixed location is so positioned that, when said toilet seat member is raised, the distance the cable runs from said arm to said location is less than the distance the cable runs from said location to said arm when said toilet seat member is in its lowered position, so that, when said seat member is in its raised position, the force exerted by said weight in response to the draining of the tank upon flushing pulls the cable and thus pivots said arm and said seat member forward to beyond said tipping position but, after the seat begins to pivot downward by gravity, it is checked in its free fall and kept from banging on the bowl by said cable and weight.

2. The apparatus of claim 1, wherein:

said seat member is the seat;

said fixed location is defined by a pulley mounted to a bracket affixed to the toilet and which has the cable running over it; and said cable runs a distance of about two inches from said pulley to said arm when said seat member is in its raised position and runs a distance of about three or more inches from said pulley to said arm when said seat member is in its lowered position, with said arm's connection to said cable being forward of said pulley when said seat member is in its raised position and is above said pulley when said seat member is in its lowered position.

3. The apparatus of claim 1, wherein:

said seat member is a lid;

said fixed location is defined by a pulley mounted to a bracket affixed to the toilet and which has the cable running over it; and said cable runs a distance of about two inches from said pulley to said arm when said seat member is in its raised position and runs a distance of about three or more inches from said pulley to said arm when said seat member is in its lowered position, with said arm's connection to said cable being forward of said pulley when said seat member is in its raised position and is above said pulley when said seat member is in its lowered position.

4. Self-lowering apparatus for lowering a toilet seat member in combination with a flush toilet, the toilet being of the type that has a water tank mounted adjacent and rearward thereof on a horizontal surface of a bowl, which tank when in operation holds water and the level of water in the tank falls upon flushing of the toilet, comprising:

a toilet seat member having means for securing it to the toilet bowl and having a rearward pivot for pivoting of said member slightly more than 90 degrees between a lowered position and a raised position, said seat member including an extension arm extending generally rearward beyond said pivot, said arm connected at one end to said seat member so as to pivot with it, such that, as the seat member pivots upward between said lowered and raised positions, the extension arm pivots downward slightly more than 90 degrees, said member having a tipping position of approximately 90 degrees with respect to said horizontal surface, which, if slightly forward thereof, said member tends to pivot downward by gravity;

a flexible cable connected at one end to said arm and at its other end to a weight at least partially submerged in the water in the tank, so that said weight will exert greater force on said cable when the water level falls in the tank than when the tank is full;

means mounting the cable so that the torque exerted by said weight through said cable in response to the draining of the tank during flushing when said seat member is in said raised position is sufficient to pivot said arm causing said seat member to pivot forward to beyond said tipping position but insufficient to raise said seat member when said seat member is in the lowered position.

5. The invention of claim 4, wherein said cable exerts positive torque on said seat member when it is in its raised position and negative torque on said seat member when it has pivoted toward its covered position.

6. The invention of claim 5, wherein said negative torque is sufficient to check the fall of said seat member so as to prevent or lessen the noise made by said member upon assuming its lowered position in response to the action of the apparatus.

* * * * *